US010213914B2

(12) United States Patent
Chen

(10) Patent No.: US 10,213,914 B2
(45) Date of Patent: Feb. 26, 2019

(54) BLOW MOLDING TOOLBOX

(71) Applicant: A-TINA TOOLS CO., LTD., Taichung (TW)

(72) Inventor: Kun-Chen Chen, Taichung (TW)

(73) Assignee: A-TINA TOOLS CO., LTD., Taichung (TW)

( * ) Notice: Subject to any disclaimer, the term of this patent is extended or adjusted under 35 U.S.C. 154(b) by 233 days.

(21) Appl. No.: 15/347,153

(22) Filed: Nov. 9, 2016

(65) Prior Publication Data

US 2018/0126544 A1 May 10, 2018

(51) Int. Cl.

| | |
|---|---|
| ***A45C 5/14*** | (2006.01) |
| ***B25H 3/02*** | (2006.01) |
| ***B65D 25/28*** | (2006.01) |
| ***B65D 45/24*** | (2006.01) |

(52) U.S. Cl.

CPC ..... *B25H 3/02* (2013.01); *B65D 25/2841* (2013.01); *B65D 45/24* (2013.01)

(58) Field of Classification Search

CPC .. A45C 13/36; A45C 3/02; A45C 5/14; A45C 5/03; B65D 85/28

USPC ..... 206/372; 190/37, 124, 18

See application file for complete search history.

(56) References Cited

U.S. PATENT DOCUMENTS

2005/0247586 A1* 11/2005 Chen ..... B25H 3/02 206/372

2014/0311847 A1* 10/2014 Hillaert ..... A45C 5/14 190/18 A

* cited by examiner

*Primary Examiner* — Anthony Stashick
*Assistant Examiner* — Raven Collins
(74) *Attorney, Agent, or Firm* — Shimokaji IP

(57) ABSTRACT

A blow molding toolbox has a casing, a cover, and multiple reinforcing elements. The casing has multiple connecting recesses, multiple guiding slots, and multiple positioning recesses. The connecting recesses are deposited on an external surface of the casing at corners of the casing. The cover is pivotally connected to the casing and has a same structure as the casing. Each one of the reinforcing elements is connected to the casing at one of the corners of the casing to cover a corresponding connecting recess of the casing or is connected to the cover at one of the corners of the cover to cover a corresponding connecting recess of the cover, and each reinforcing element has a body, at least one fixing tube, and at least one tapping screw. The reinforcing elements may increase the structural strength of the blow molding toolbox.

9 Claims, 8 Drawing Sheets

BLOW MOLDING TOOLBOX

BACKGROUND OF THE INVENTION

1. Field of the Invention

The present invention relates to a blow molding toolbox, and more particularly to a blow molding toolbox that may increase the structural strength, may provide a buffering effect when the blow molding toolbox hits objects or falls on the ground, and may improve the visual appeal of the blow molding toolbox.

2. Description of Related Art

A conventional blow molding toolbox is used to store objects such as handheld tools and has a casing and a cover. The cover is pivotally connected to the casing to selectively cover the casing, and this may form a receiving space between the casing and the cover to store the handheld tools. The conventional blow molding toolbox may be made of plastic and may be formed in a mold by a blow molding method. The casing and the cover of the conventional blow molding toolbox respectively have an internal hollow structure to reduce the overall weight of the conventional blow molding toolbox, and this is convenient in carriage.

Although the conventional blow molding toolbox can be made conveniently by the blow molding method and is easy to carry, the structural strength of the conventional blow molding toolbox is insufficient. Since each one of the casing and the cover of the conventional blow molding toolbox has the internal hollow structure, when the conventional blow molding toolbox knocks against objects or falls on the ground, one of the corners of the casing or the cover may be broken or damaged, and this will shorten the lifespan of the conventional blow molding toolbox. In addition, the conventional blow molding toolbox is made of plastic and cannot provide a buffering effect when the conventional blow molding toolbox knocks against objects or falls on the ground.

To overcome the shortcomings, the present invention provides a blow molding toolbox to mitigate or obviate the aforementioned problems.

SUMMARY OF THE INVENTION

The main objective of the present invention is to provide a blow molding toolbox which is made by a blow molding method, and more particularly to a blow molding toolbox that may increase the structural strength, may provide a buffering effect when the blow molding toolbox hits objects or falls on the ground, and may improve the visual appeal of the blow molding toolbox.

The blow molding toolbox in accordance with the present invention has a casing, a cover, and multiple reinforcing elements. The casing has multiple connecting recesses, multiple guiding slots, and multiple positioning recesses. The connecting recesses are deposited on an external surface of the casing at corners of the casing. The cover is pivotally connected to the casing and has a same structure as the casing. Each one of the reinforcing elements is connected to the casing at one of the corners of the casing to cover a corresponding connecting recess of the casing or is connected to the cover at one of the corners of the cover to cover a corresponding connecting recess of the cover, and each reinforcing element has a body, at least one fixing tube, and at least one tapping screw. The reinforcing elements may increase the structural strength of the blow molding toolbox.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
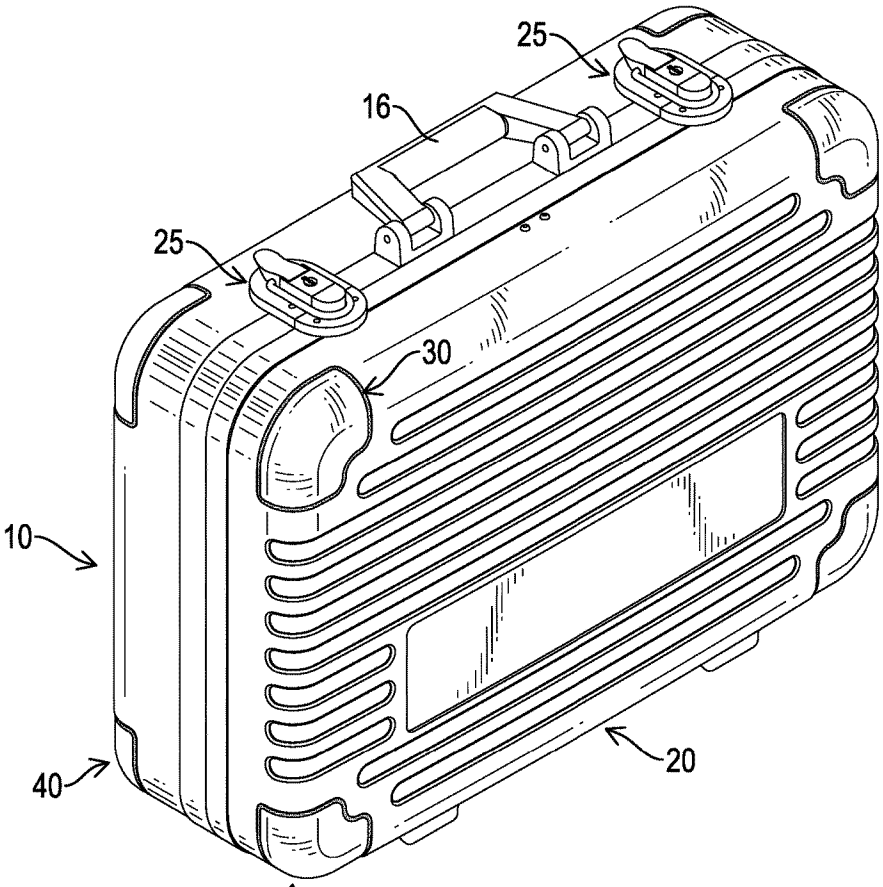
FIG. 1 is a perspective view of a blow molding toolbox in accordance with the present invention.

With reference to FIG. 1, a blow molding toolbox in accordance with the present invention is made of plastics by a blow molding method and comprises a casing 10, a cover 20, multiple reinforcing elements 30, and multiple buffering elements 40.

With reference to FIGS. 2 to 5, the casing 10 has an external surface, an internal surface, a top side, a front side, a rear side, two opposite sides, four corners, a top opening, a forming space 11, at least one storage recess 12, multiple connecting recesses 13, multiple guiding slots 14, multiple positioning recesses 15, and a handgrip 16. The opposite sides of the casing 10 are formed with the front side and the rear side of the casing 10 and face to each other. The corners are deposited on the external surface of the casing 10 between the front side, the rear side, and the two opposite sides of the casing 10. The top opening is formed through the top side of the casing 10 between the front side, the rear side, and the two opposite sides of the casing 10.

The forming space 11 is a closed space and is formed in the casing 10 between the internal surface and the external surface of the casing 10 by the blow molding method. The at least one storage recess 12 is formed in the internal surface of the casing 10, communicates with the top opening of the casing 10, and is used to store a handheld tool. In addition, the casing 10 may have multiple storage recesses 12 formed in the internal surface of the casing 10 at spaced intervals with different sizes for storing handheld tools of different kinds and sizes. The connecting recesses 13 are deposited on the external surface of the casing 10 at the corners of the casing 10. Furthermore, the casing 10 has four connecting recesses 13 respectively deposited on the four corners of the casing 10.

At least one of the guiding slots 14 is deposited in the external surface of the casing 10 at each one of the corners of the casing 10. Furthermore, there are two of the guiding slots 14 deposited in the external surface of the casing 10 at each one of the corners of the casing 10. At least one of the positioning recesses 15 is deposited in the internal surface of the casing 10 at each one of the corners of the casing 10 and aligns with the at least one guiding slot 14 that is formed at the same corner of the casing 10. Additionally, there are two of the positioning recesses 15 formed in the internal surface of the casing 10 at each one of the corners of the casing 10, and respectively align with the two guiding slots 14 that are formed at the same corner of the casing 10. The handgrip 16 is pivotally deposited on the front side of the casing 10.

Figure 6:
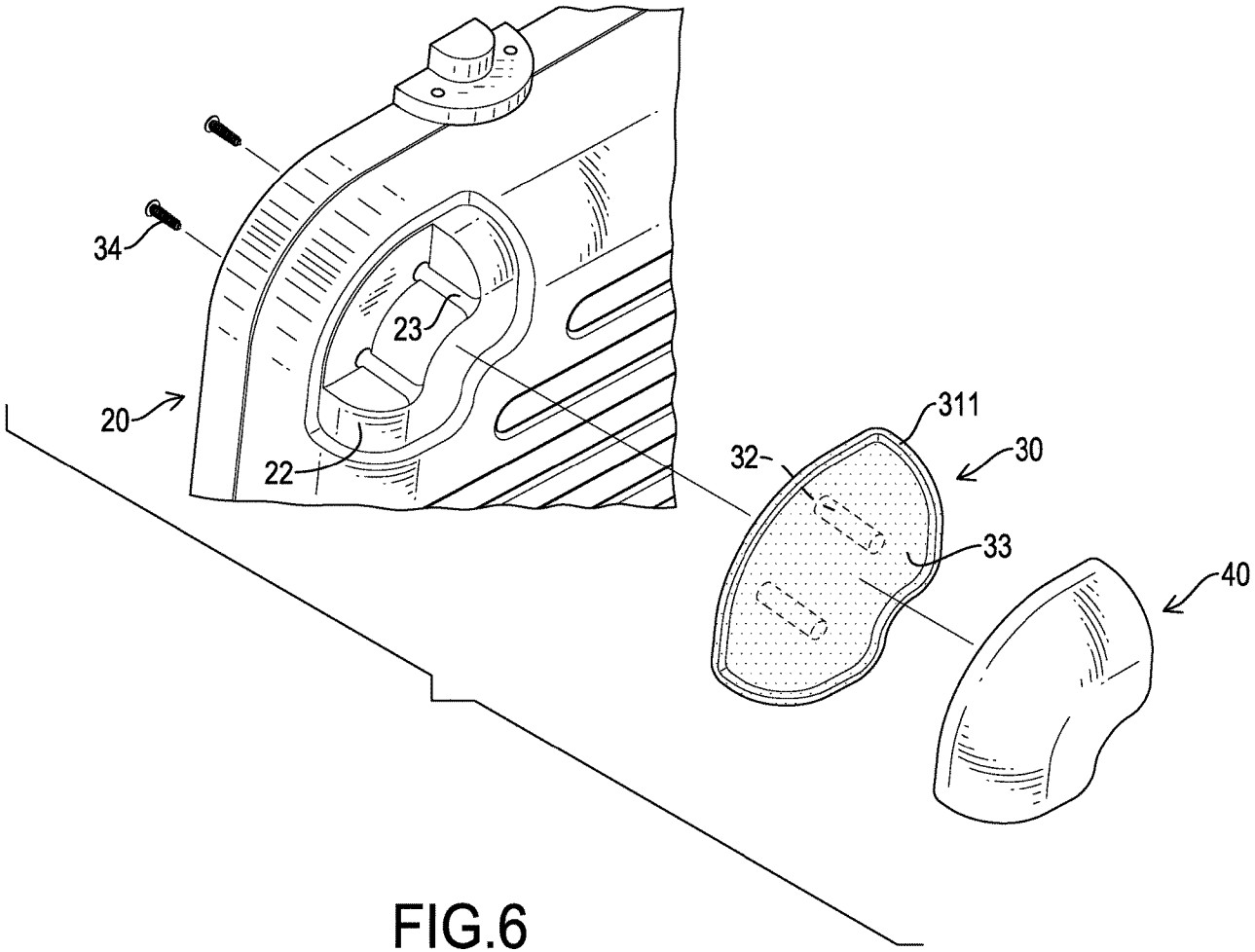
FIG. 6 is an enlarged exploded perspective view of a cover of the blow molding toolbox in FIG. 1.
Figure 7:
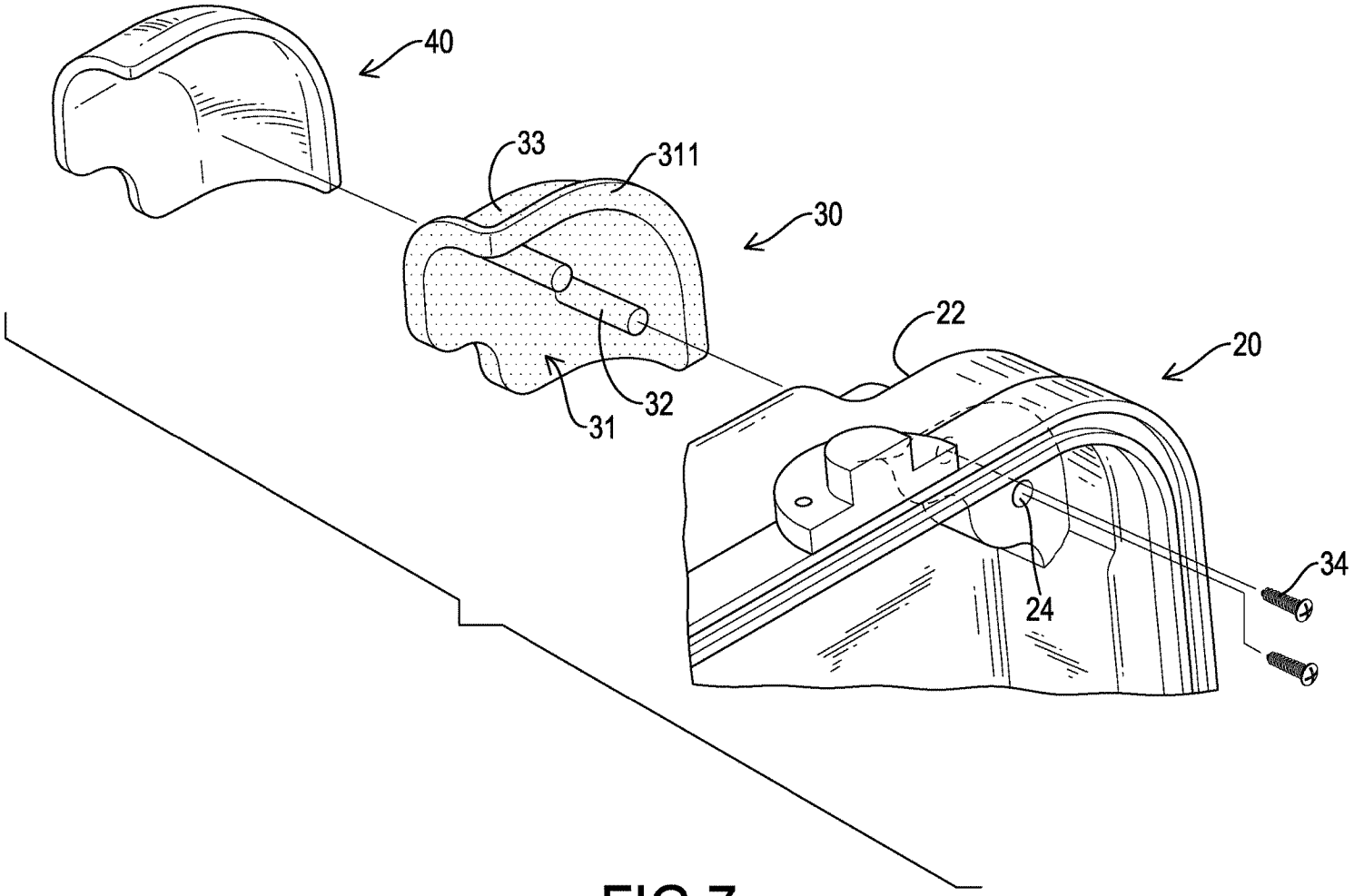
FIG. 7 is another enlarged exploded perspective view of the cover of the blow molding toolbox in FIG. 1.
Figure 8:
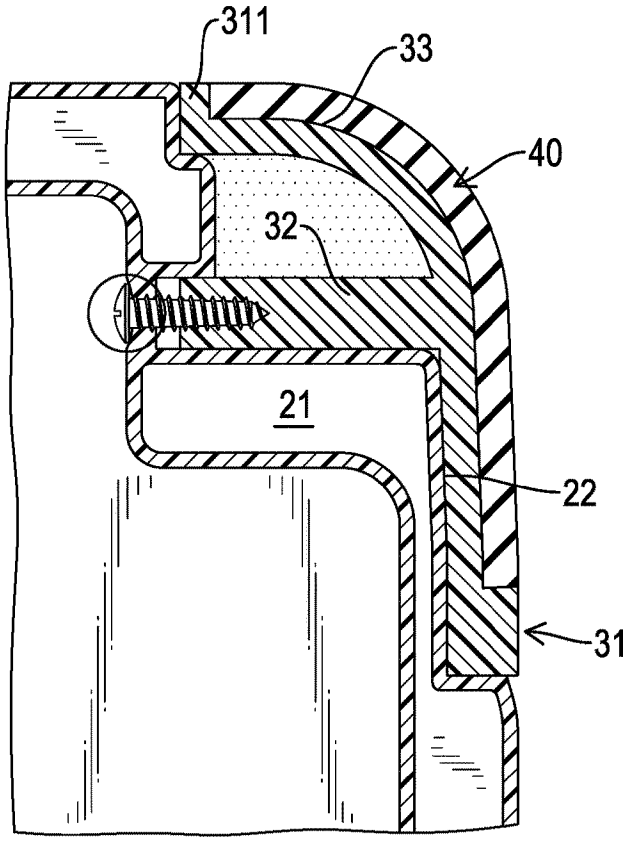
FIG. 8 is an enlarged side view in partial section of the cover of the blow molding toolbox in FIG. 1.

With reference to FIGS. 6 to 8, the cover 20 is pivotally connected to the casing 10 and has an external surface, an internal surface, a front side, a rear side, two opposite sides, a bottom side, a top side, four corners, a bottom opening, a forming space 21, multiple connecting recesses 22, multiple guiding slots 23, multiple positioning recesses 24, and at least one locking set 25. The opposite sides of the cover 20 are formed with the front side and the rear side of the cover 20 and face to each other. The corners are deposited on the external surface of the cover 20 between the front side, the rear side, and the two opposite sides of the cover 20. The bottom opening is formed through the bottom side of the cover 20 between the front side, the rear side, and the two opposite sides of the cover 20, and is corresponding in position to the top opening of the casing 10.

The forming space 21 is a closed space and is formed in the cover 20 between the internal surface and the external surface of the cover 20 by the blow molding method. The connecting recesses 22 of the cover 20 are deposited on the external surface of the cover 20 at the corners of the cover 20. Furthermore, the cover 20 has four connecting recesses 22 respectively deposited on the four corners of the cover 20. At least one of the guiding slots 23 of the cover 20 is deposited in the external surface of the cover 20 at each one of the corners of the cover 20. Furthermore, there are two of the guiding slots 23 of the cover 20 deposited in the external surface of the cover 20 at each one of the corners of the cover 20.

At least one of the positioning recesses 24 of the cover 20 is deposited in the internal surface of the cover 20 at each one of the corners of the cover 20 and aligns with the at least one guiding slot 23 that is formed at the same corner of the cover 20. Additionally, there are two of the positioning recesses 24 formed in the internal surface of the cover 20 at each one of the corners of the cover 20, and respectively align with the two guiding slots 23 that are formed at the same corner of the cover 20. The at least one locking set 25 is deposited between the front sides of the casing 10 and the cover 20 to hold the cover 20 securely with the casing 10 to cover the top opening and the at least one storage recess 12 of the casing 10 by the cover 20. In addition, the cover 20 has two locking sets 25 deposited between the front sides of the casing 10 and the cover 20 beside the handgrip 16.

Each one of the reinforcing elements 30 is connected to the casing 10 at one of the corners of the casing 10 to cover a corresponding connecting recess 13 of the cover 10 or is connected to the cover 20 at one of the corners of the cover 20 to cover a corresponding connecting recess 22 of the cover 20, and each reinforcing element 30 has a body 31, at least one fixing tube 32, at least one tapping screw 33, and a mounting recess 34.

The body 31 of the reinforcing element 30 has a shape corresponding to the corresponding connecting recess 13, 22 of the casing 10 or the cover 20, and has an inner side and an outer side. The inner side of the body 31 faces the corresponding connecting recess 13, 22 of the casing 10 or the cover 20. The at least one fixing tube 32 is formed on and protrudes from the inner side of the body 31, extends into the forming space 11, 21 of the casing 10 or the cover 20 via the at least one of the guiding slots 14, 23 that is deposited in the corresponding connecting recess 13, 22 of the casing 10 or the cover 20, and aligns with the at least one of the positioning recesses 15, 24 of the casing 10 or the cover 20 that corresponds to the guiding slot 14, 23 of the casing 10 or the cover 20.

Figure 5A:
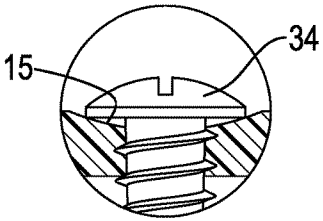
FIG. 5A is a further enlarged side view in partial section of the casing of the blow molding toolbox in FIG. 5.
Figure 5:
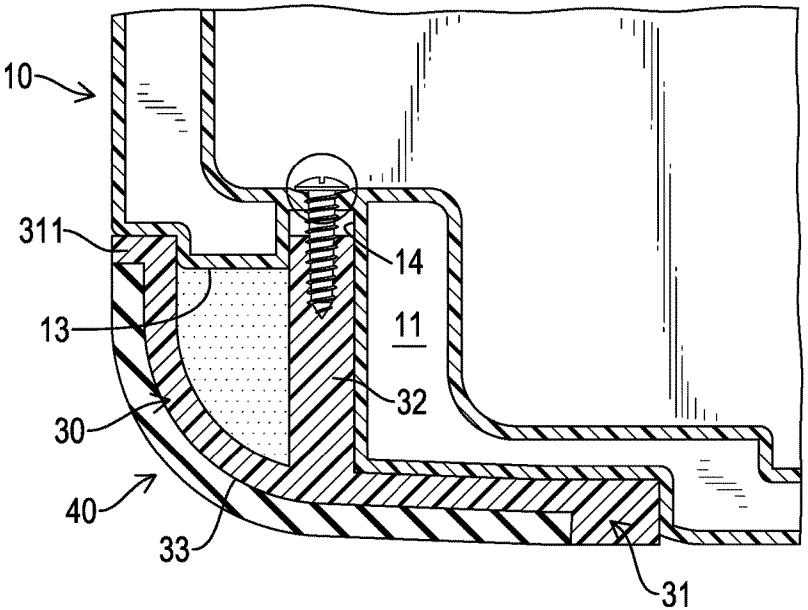
FIG. 5 is an enlarged side view in partial section of the casing of the blow molding toolbox in FIG. 1.
Figure 8A:
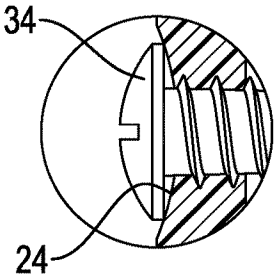
FIG. 8A is a further enlarged side view in partial section of the casing of the blow molding toolbox in FIG. 8.

With further reference to FIGS. 5A and 8A, the at least one tapping screw 33 is tapped through the corresponding positioning recess 15, 24 of the casing 10 or the cover 20, and is securely connected to the at least one fixing tube 32 of the reinforcing element 30 to hold the reinforcing element 30 securely on the casing 10 or the cover 20 at the corresponding corner of the casing 10 or the cover 20. Additionally, each reinforcing element 30 has two fixing tubes 32 formed on and protruding from the inner side of the body 31, and two tapping screws 33 respectively connected to the two fixing tubes 32 of the reinforcing element 30.

The mounting recess 34 is formed in the outer side of the body 31 and has a shape corresponding to the shape of the body 31 to form an outer flange 311 around the body 31. Furthermore, the blow molding toolbox has eight reinforcing elements 30 respectively connected to the eight corners of the casing 10 and the cover 20. In addition, each one of the reinforcing elements 30 may be made of acrylonitrile-butadiene-styrene (ABS) and has a color.

The buffering elements 40 are respectively connected to the reinforcing elements 30 at the corners of the casing 10 and the cover 20. Each one of the buffering elements 40 is deposited in the mounting recess 34 of one of the reinforcing elements 30 at one of the corners of the casing 10 or the cover 20, and the outer flange 311 of the body 31 of the corresponding reinforcing element 30 is deposited around the buffering element 40. Additionally, each one of the buffering elements 40 may be made of thermo-plastic rubber and has a color different from the color of each one of the reinforcing elements 30. Then, the outer flange 311 of the body 31 of each one of the reinforcing elements 30 and the buffering element 40 that is deposited on the body 31 of the corresponding reinforcing element 30 may improve the visual appeal of the blow molding toolbox with different colors at the corners of the casing 10 and the cover 20.

Figure 2:
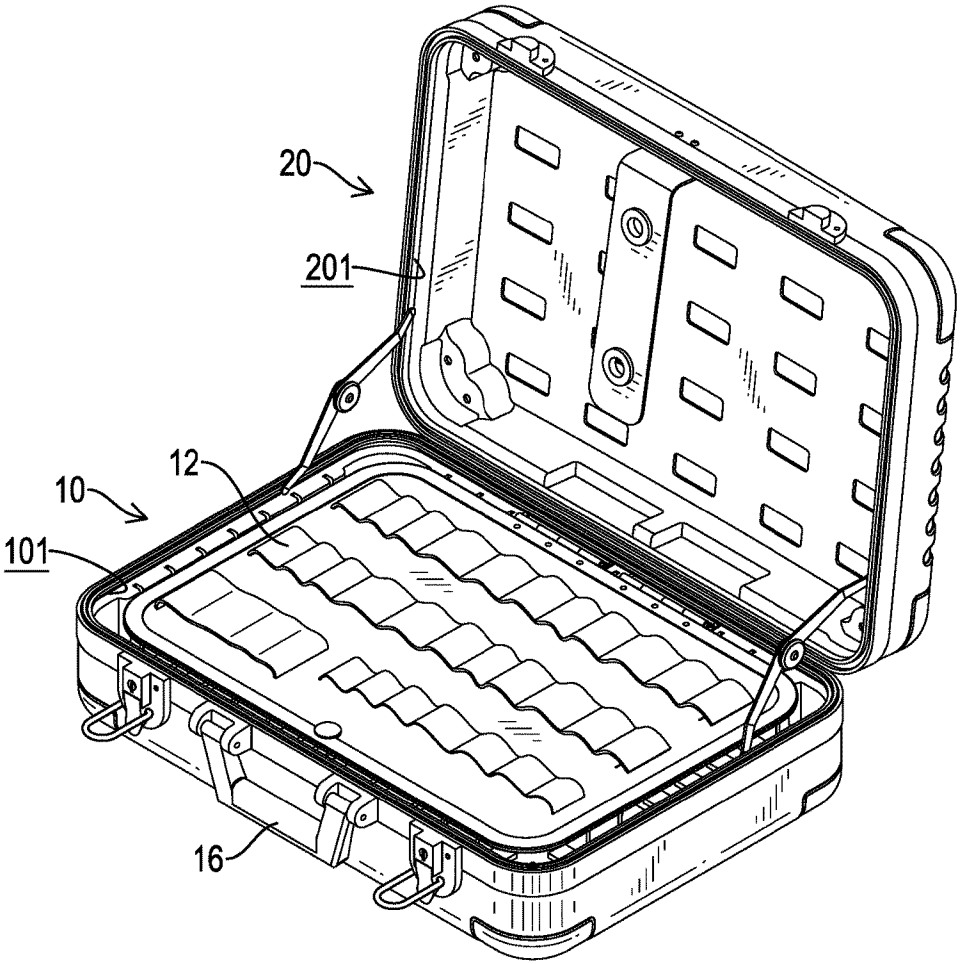
FIG. 2 is an operational perspective view of the blow molding toolbox in FIG. 1, shown in an open condition.
Figure 3:
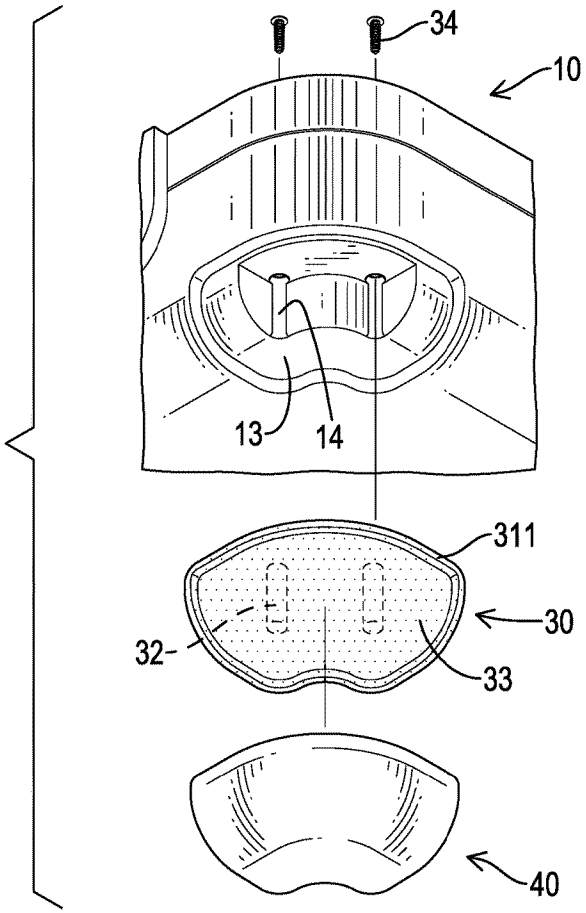
FIG. 3 is an enlarged exploded perspective view of a casing of the blow molding toolbox in FIG. 1.
Figure 4:
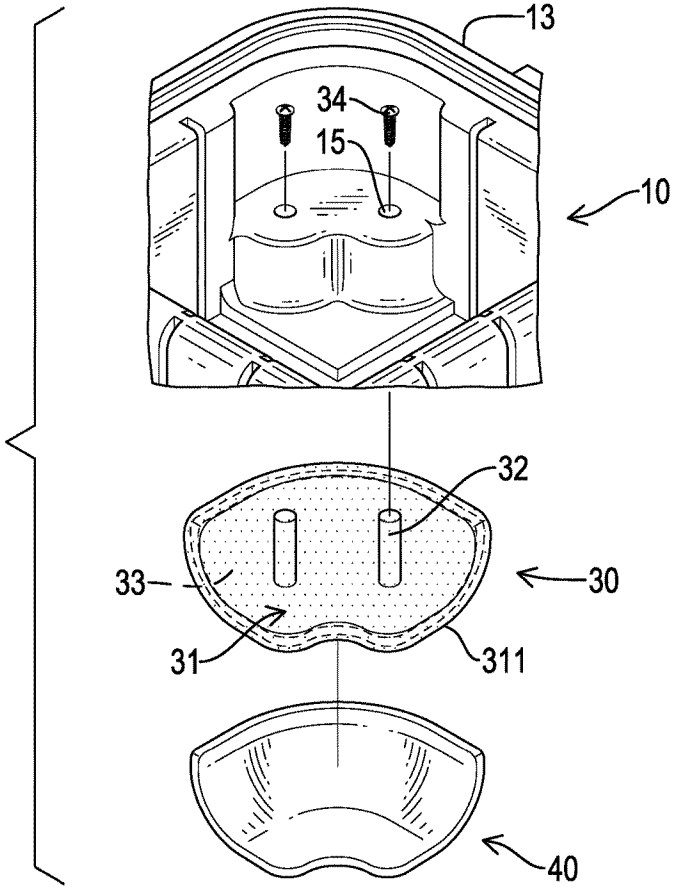
FIG. 4 is another enlarged exploded perspective view of the casing of the blow molding toolbox in FIG. 1.

In use, with reference to FIGS. 1 and 2, the reinforcing elements 30 are connected to the casing 10 and the cover 20 at the corners of the casing 10 and the cover 20, and this may increase the structural strengths of the casing 10 and the cover 20. Then, the structural strength of the blow molding toolbox may be improved. Additionally, with reference to FIGS. 5 and 8, the buffering elements 40 are deposited on the reinforcing elements 30 at the corners of the casing 10 and the cover 20. When the blow molding toolbox stores handheld tools to transport, the blow molding toolbox may knock against objects, and the reinforcing elements 30 may enable the blow molding toolbox to have a sufficient structural strength to withstand the impact force of the objects without breaking at the corners of the casing 10 and the cover 20. In addition, the buffering elements 40 may provide a buffering effect to the blow molding toolbox when the blow molding toolbox falls on the ground, and this may reduce the damage to the blow molding toolbox at the corners of the casing 10 and the cover 20. Consequently, the lifespan of the blow molding toolbox also can be longer than the conventional blow molding toolbox. Additionally, the colors of the reinforcing elements 30 and the buffering elements 40 are different, and this may improve the visual appeal of the blow molding toolbox at the corners of the casing 10 and the cover 20.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A blow molding toolbox having:

a casing having
- an external surface;
- an internal surface;
- a top side;
- a front side;
- a rear side;
- two opposite sides formed with the front side and the rear side of the casing and facing to each other;
- four corners deposited on the external surface of the casing between the front side, the rear side, and the two opposite sides of the casing;
- a top opening formed through the top side of the casing between the front side, the rear side, and the two opposite sides of the casing;
- a forming space being a closed space and formed in the casing between the internal surface and the external surface of the casing;
- at least one storage recess formed in the internal surface of the casing and communicating with the top opening of the casing;
- multiple connecting recesses deposited on the external surface of the casing at the corners of the casing;
- multiple guiding slots, and at least one of the guiding slots deposited in the external surface of the casing at each one of the corners of the casing; and
- multiple positioning recesses, and at least one of the positioning recesses deposited in the internal surface of the casing at each one of the corners of the casing and aligning with the at least one guiding slot that is formed at the same corner of the casing;

a cover pivotally connected to the casing and having
- an external surface;
- an internal surface;
- a front side;
- a rear side;
- two opposite sides formed with the front side and the rear side of the cover and facing to each other;
- a bottom side;
- a top side;
- four corners deposited on the external surface of the cover between the front side, the rear side, and the two opposite sides of the cover;
- a bottom opening formed through the bottom side of the cover between the front side, the rear side, and the two opposite sides of the cover, and corresponding in position to the top opening of the casing;
- a forming space being a closed space and formed in the cover between the internal surface and the external surface of the cover;
- multiple connecting recesses deposited on the external surface of the cover at the corners of the cover;
- multiple guiding slots, and at least one of the guiding slots of the cover deposited in the external surface of the cover at each one of the corners of the cover; and
- multiple positioning recesses, and at least one of the positioning recesses of the cover deposited in the internal surface of the cover at each one of the corners of the cover and aligning with the at least one guiding slot that is formed at the same corner of the cover;

multiple reinforcing elements, each one of the reinforcing elements connected to the casing at one of the corners of the casing to cover a corresponding connecting recess of the cover or connected to the cover at one of the corners of the cover to cover a corresponding connecting recess of the cover, and each reinforcing element having a body having
- a shape corresponding to the corresponding connecting recess of the casing or the cover;
- an inner side facing the corresponding connecting recess of the casing or the cover; and
- an outer side;

at least one fixing tube formed on and protruding from the inner side of the body, extending into the forming space of the casing or the cover via the at least one of the guiding slots that is deposited in the corresponding connecting recess of the casing or the cover, and aligning with the at least one of the positioning recesses of the casing or the cover that corresponds to the guiding slot of the casing or the cover;

at least one tapping screw tapped through the corresponding positioning recess of the casing or the cover, and securely connected to the at least one fixing tube of the reinforcing element to hold the reinforcing element securely on the casing or the cover at the corresponding corner of the casing or the cover; and a mounting recess formed in the outer side of the body and having a shape corresponding to the shape of the body to form an outer flange around the body; and multiple buffering elements respectively connected to the reinforcing elements at the corners of the casing and the cover, and each one of the buffering elements deposited in the mounting recess of one of the reinforcing elements at one of the corners of the casing or the cover, and the outer flange of the body of the corresponding reinforcing element deposited around the buffering element.

2. The blow molding toolbox as claimed in claim 1, wherein
- each one of the reinforcing elements has a color; and
- each one of the buffering elements has a color different from the color of each one of the reinforcing elements;
- wherein the outer flange of the body of each one of the reinforcing elements and the buffering element that is deposited on the body of the corresponding reinforcing element have different colors.

3. The blow molding toolbox as claimed in claim 2, wherein
- the casing has four connecting recesses respectively deposited on the four corners of the casing;
- the cover has four connecting recesses respectively deposited on the four corners of the cover; and
- the blow molding toolbox has eight reinforcing elements respectively connected to the connecting recesses at the corners of the casing and the cover.

4. The blow molding toolbox as claimed in claim 3, wherein two of the guiding slots of the casing are deposited in the external surface of the casing at each one of the corners of the casing;

two of the positioning recesses of the casing are formed in the internal surface of the casing at each one of the corners of the casing, and respectively align with the two guiding slots that are formed at the same corner of the casing;

two of the guiding slots of the cover are deposited in the external surface of the cover at each one of the corners of the cover;

two of the positioning recesses of the cover are formed in the internal surface of the cover at each one of the corners of the cover, and respectively align with the two guiding slots that are formed at the same corner of the cover; and each reinforcing element has two fixing tubes formed on and protruding from the inner side of the body, and two tapping screws respectively connected to the two fixing tubes of the reinforcing element via the corresponding guiding slots and positioning recesses of the casing or via the corresponding guiding slots and positioning recesses of the cover.

5. The blow molding toolbox as claimed in claim 4, wherein the casing has multiple storage recesses of different sizes formed in the internal surface of the casing at spaced intervals.

6. The blow molding toolbox as claimed in claim 5, wherein the casing has a handgrip pivotally deposited on the front side of the casing; and the cover has at least one locking set deposited between the front sides of the casing and the cover to hold the cover securely with the casing to cover the top opening and the storage recesses of the casing by the cover.

7. The blow molding toolbox as claimed in claim 6, wherein the cover has two locking sets deposited between the front sides of the casing and the cover beside the handgrip.

8. The blow molding toolbox as claimed in claim 1, wherein two of the guiding slots of the casing are deposited in the external surface of the casing at each one of the corners of the casing;

two of the positioning recesses of the casing are formed in the internal surface of the casing at each one of the corners of the casing, and respectively align with the two guiding slots that are formed at the same corner of the casing;

two of the guiding slots of the cover are deposited in the external surface of the cover at each one of the corners of the cover;

two of the positioning recesses of the cover are formed in the internal surface of the cover at each one of the corners of the cover, and respectively align with the two guiding slots that are formed at the same corner of the cover; and each reinforcing element has two fixing tubes formed on and protruding from the inner side of the body, and two tapping screws respectively connected to the two fixing tubes of the reinforcing element via the corresponding guiding slots and positioning recesses of the casing or via the corresponding guiding slots and positioning recesses of the cover.

9. The blow molding toolbox as claimed in claim 1, wherein the casing has multiple storage recesses of different sizes formed in the internal surface of the casing at spaced intervals; and a handgrip pivotally deposited on the front side of the casing; and the cover has at least one locking set deposited between the front sides of the casing and the cover to hold the cover securely with the casing to cover the top opening and the at least one storage recess of the casing by the cover.

* * * * *